US006404141B1

(12) United States Patent
Miyazaki et al.

(10) Patent No.: US 6,404,141 B1
(45) Date of Patent: Jun. 11, 2002

(54) ELECTRODELESS DISCHARGE LAMP

(75) Inventors: Kouji Miyazaki, Osaka; Shingo Matsumoto, Kadoma; Mamoru Takeda, Kyoto, all of (JP); Young-Jae Cho, Seoul (KR); Toshiaki Kurachi, Osaka (JP); Robert Chandler, Lexington, MA (US); Oleg Popov, Needham, MA (US); Jakob Maya, Brookline, MA (US)

(73) Assignees: Matsushita Electric Industrial Co., Ltd.; Matsushita Electric Works, Ltd., both of Osaka (JP)

( * ) Notice: Subject to any disclaimer, the term of this patent is extended or adjusted under 35 U.S.C. 154(b) by 0 days.

(21) Appl. No.: 09/520,103

(22) Filed: Mar. 7, 2000

(51) Int. Cl.[7] ..... H01J 61/52
(52) U.S. Cl. ..... 315/248; 313/234; 313/607
(58) Field of Search ..... 315/248, 267; 313/234, 607, 17, 18

(56) References Cited

U.S. PATENT DOCUMENTS 5,621,266 A * 4/1997 Popov et al. ..... 313/46

FOREIGN PATENT DOCUMENTS

| | | |
|---|---|---|
| JP | 55-146862 | 11/1980 |
| JP | 60-136159 | 7/1985 |
| JP | 61-096649 | 5/1986 |
| JP | 09-050789 | 2/1997 |
| JP | 10-112293 | 4/1998 |

* cited by examiner

*Primary Examiner*—David Vu
(74) *Attorney, Agent, or Firm*—Kinney & Lange, P.A.

(57) ABSTRACT

In a conventional electrodeless discharge lamp, a large amount of magnetic field leaks from at light-transparent envelope, and the efficiency of conversion from electric power to light energy is low.

In a electrodeless discharge lamp in which light-emitting gases in a light-transparent envelope are excited with a magnetic field generated from a coil, end portions of a magnetic material included in the coil are substantially axially disposed in the light-transparent envelope. As a result, the magnetic flux which leaks outside the light-transparent envelope is decreased so the density of the magnetic flux in the envelope is increased and the efficiency of the lamp is improved.

11 Claims, 11 Drawing Sheets

Y-Y' CROSS-SECTION

ELECTRODELESS DISCHARGE LAMP

DETAILED DESCRIPTION OF THE INVENTION

1. Field of the Invention

The present invention relates to an electrodeless discharge lamp.

2. Prior Art

An electrodeless discharge lamp generates visible light, UV light, or the like by exciting light-emitting gases such as an inert gas, mercury, and metal halide with an electromagnetic wave generated from a coil. Because of the electrodeless structure, the electrodeless discharge lamp is unlikely to degrade, resulting in a long life. Thus, in recent years since resource-saving has been sought, there is an increasing demand for development of the electrodeless discharge lamp.

FIG. 12 is a cross-sectional view of a main portion (light-transparent envelope) having a structure of a conventional electrodeless discharge lamp disclosed in Japanese laid open Publication No. 10-112293. Reference numeral 1201 denotes a base for supplying alternating current (AC) power. Reference numeral 1202 denotes a power source circuit which generates a sine wave and is connected to the base 1201 and a coil 1203. A magnetic material such as ferrite is disposed in the coil 1203. It is considered that the magnetic material is linear and positioned so as to be perpendicular to the axis of the lamp passing through the center of the base.

In the above-mentioned structure, an end portion of the magnetic material of the coil is not directed toward the base. Therefore, there are advantages in that the possibility of interference between the magnetic field and a metal portion of the lighting equipment in relatively small, and an operation point is not likely to be moved by changes in inductance, etc.

PROBLEMS TO BE SOLVED BY THE INVENTION

However, in the electrodeless discharge lamp with the above-mentioned structure, a half or more of the magnetic field generated by the coil leaks outside from the light-transparent envelope, as represented by a magnetic field δ in FIG. 12. Therefore, magnetic flux which is generated inside the light-transparent envelope and contributes to light emission of the lamp is reduced to a half or less of the entire magnetic flux, which decreases the light emission efficiency of the lamp.

Furthermore, the magnetic field which leaks in the direction of the base interferes with lighting equipment, which changes inductance and moves an operation point to decrease the light emission efficiency of the lamp.

Furthermore, the density of the magnetic flux in the envelope is not uniform and brightness in the light-transparent envelope becomes non-uniform depending upon the position during light emission, which degrades the quality of the lamp.

SUMMARY OF THE INVENTION

The present invention solves the above-mentioned problems. More specifically, the objective of the present invention is to improve a light emission efficiency of the lamp by suppressing magnetic flux which leaks outside the light-transparent envelope, thereby preventing interference between the magnetic flux and the metal portion of lighting equipment and increasing the density of magnetic flux generated inside the light-transparent envelope.

In order to achieve the above-mentioned objective, the electrodeless discharge lamp of the present invention is composed of a light-transparent envelope in which light-emitting materials such as an inert gas, mercury and metal halide are sealed and a coil having a magnetic material which applies an electromagnetic field to the light-transparent envelope. In at least one structure of the coil, at least one end portion of the magnetic material is disposed substantially parallel to the axis of the light-transparent envelope.

Furthermore, the present invention is characterized in that the end portions of the magnetic material have the maximum density of magnetic flux.

Furthermore, the present invention is characterized in that both ends of the magnetic material are substantially parallel to the axis of the light-transparent envelope.

Furthermore, the present invention is characterized in that the magnetic material has three or more end portions, and a part or an entirety of the end portions are disposed substantially parallel to the axis of the light-transparent envelope.

Furthermore, the present invention is characterized in that a part or all of the magnetic material is a material magnetized in a particular direction.

Furthermore, the present invention is characterized in that the coil reaches the vicinity of the end portions of the magnetic material.

Furthermore, the present invention is characterized in that the end portions of the magnetic material are edge portions substantially in the shape of a circle or of a polygon, and end portions of the magnetic material having an opposite polarity of that of the edge portions are preset in the edge portions.

Furthermore, the present invention is characterized in that a power source circuit for supplying high-frequency electric power to the coil is built in the lamp.

EMBODIMENTS OF THE INVENTION

EXAMPLE 1

Hereinafter, the present invention will be described by way of illustrative examples with reference to the drawings.

Figure 1A:
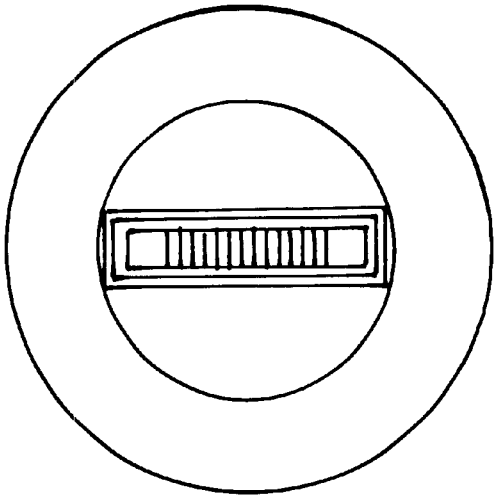
FIG. 1: Three cross-sectional views (a, b & c) of the main portion of an electrodeless discharge lamp described in Example 1.
Figure 1B:
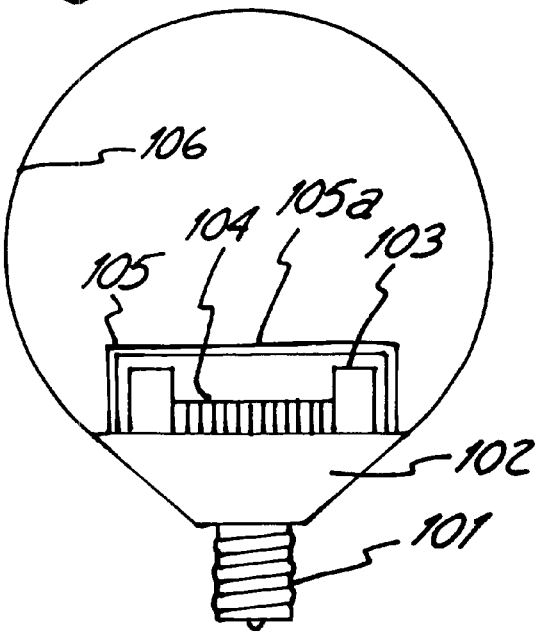
Figure 1C:
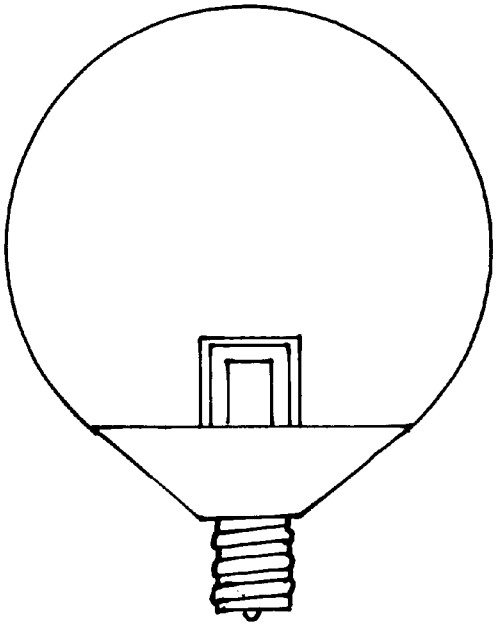

FIG. 1 shows three cross-sectional views of a main portion of an electrodeless discharge lamp according to one embodiment of the invention. Reference numeral 101 denotes a base for supplying AC power. Reference numeral 102 denotes a power source portion including a power source circuit generating an AC potential with a substantially sine wave waveform, which is connected to the base 101 and a coil 104. Reference numeral 103 denotes a magnetic material (e.g., Mn—Zn ferrite) in the shape of "⊏" disposed in the coil 104. As shown in FIG. 1(*b*), both ends of the magnetic material 103 are characterized by protruding toward the vicinity of the center of the light-transparent envelope. A light-transparent envelope 106 is a part of a sphere, and the inner surface thereof is coated with a phosphor which is excited with UV light to emit visible light. Furthermore, an inert gas (e.g., argon gas) and mercury are sealed in the light-transparent envelope 106 as light-emitting gases. An opening 105*a* is provided in a cover 105 which separates the coil 104 and the magnetic material 103 from a light-emitting region.

In operation, the electrodeless discharge lamp with the above-mentioned structure receives utility power through the base 101 to supply a sinusoidal voltage to the coil 104 from power source circuit 102. When the coil 104 receives a sinusoidal voltage, a sinusoidal current flows through the coil 104 and is transmitted through the magnetic material 103 to release a sinusoidal magnetic field in the light-transparent envelope 106. The generated sinusoidal magnetic field generates a plasma in the light-transparent envelope 106. Because of this, argon gas and mercury are excited to emit UV and visible light. A part of the generated visible light is transmitted through the light-transparent envelope 106 and the generated UV light excites a phosphor coated on the inner surface of the light-transparent envelope to emit visible light. Due to the above-mentioned function, when the base 101 is supplied with the utility power, the electrodeless discharge lamp in the present example emits visible light through the light-transparent envelope 106.

Figure 2:
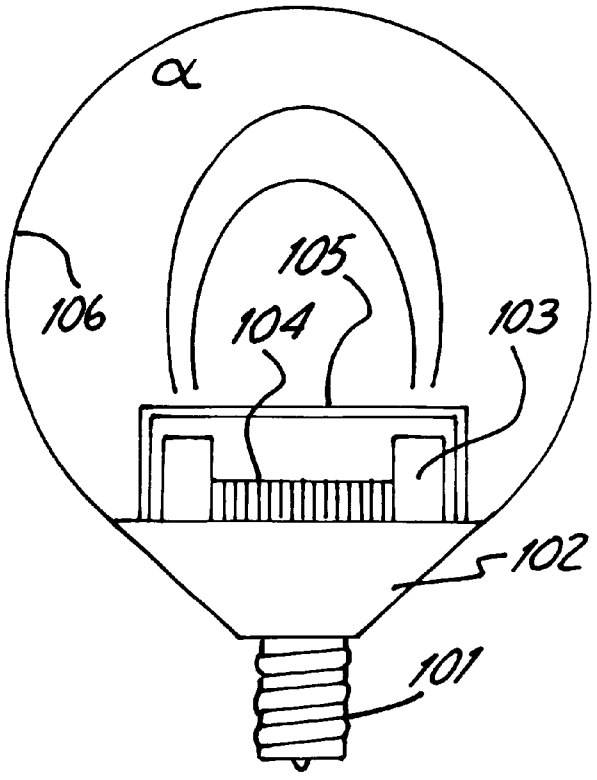
FIG. 2: A view showing the position of an AC magnetic field during operation in the electrodeless discharge lamp shown in FIG. 1.

A magnetic field α shown in FIG. 2 represents a magnetic line of force generated from the coil 104 of the electrodeless discharge lamp in the present example. The magnetic material 103 has the shape of "⊏" and both ends thereof are disposed adjacent the vicinity of the axis of the light-transparent envelope 106. Therefore, a magnetic path becomes likely to be formed in the light-transparent envelope 106. As described above, a magnetic path is curved in the magnetic material and most of the magnetic field circulates in the light-transparent envelope 106 as represented by the magnetic line of force α which decreases the magnetic flux leaking outside the light-transparent envelope 106. Thus, when compared with a conventional electrodeless-discharge lamp, a plasma is more strongly generated in the light-transparent envelope 106 and coupled with more light-emitting gases to emit UV light and visible light. More specifically, the structure of the lamp in the present example has the advantage that a light emission efficiency is more satisfactory than the conventional electrodeless discharge lamp.

Furthermore, since the magnetic field leaks less, there is the advantage that the interference between the magnetic field and a metal portion of lighting equipment is suppressed and heat generation and movement of an operation point are decreased.

In the present example, both ends of the magnetic material are arranged substantially parallel to the axis of the light-transparent envelope. However, the same effect can be obtained even if only one end is arranged in this manner.

In the present example, only a horizontal portion of the magnetic material is coiled. However, if curved portions are coiled so that the coil reaches the vicinity of the end portions, the inductance of the coil is enhanced and the light emission efficiency can be increased.

EXAMPLE 2

Figure 3A:
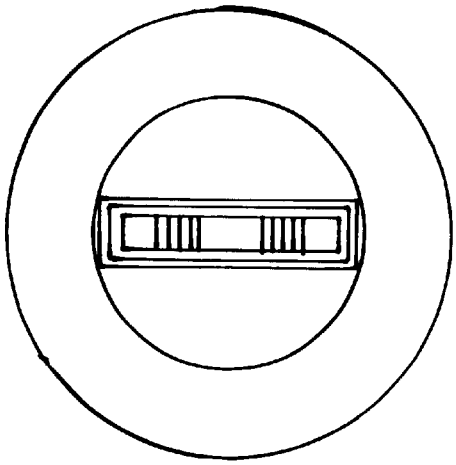
FIG. 3: Three cross-sectional views (a, b & c) of the main portion of an electrodeless discharge lamp described in Example 2.
Figure 3B:
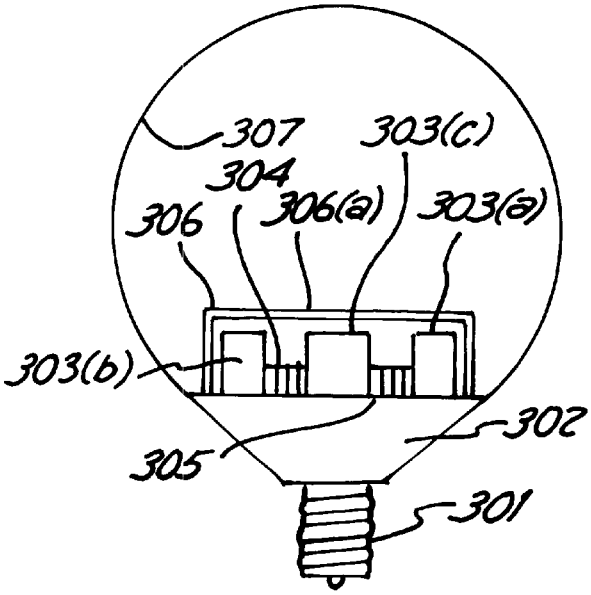
Figure 3C:
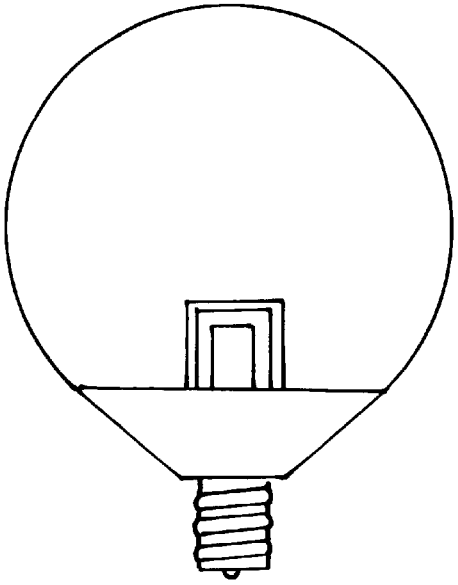

FIG. 3 shows three cross-sectional views of a main portion (light-transparent envelope) of an electrodeless discharge lamp of another example of the present invention. Reference numeral 301 shows the base for supplying AC power. Reference numeral 302 denotes a power source portion including a power source circuit generating an AC with a substantially sine wave waveform, which is connected to the base 301, a coil 304 and a coil 305. A winding direction of the coil 304 is opposite to that of the coil 305, and they are respectively connected to the power source circuit. Reference numeral 303 denotes a magnetic material, e.g. Mn—Zn:ferrite. Furthermore, a magnetic material includes projections 303(*a*), 303(*b*), 303(*c*) directed substantially parallel to the axis of a light-transparent envelope at three portions, the ends being parallel to the axis. The light-transparent envelope 307 has a substantially spherical shape and the inner surface thereof is coated with a phosphor which receives UV light to emit visible light. An inert gas (e.g., argon gas) and mercury are sealed in the light-transparent envelope 307 as light-emitting gases. A cover 306 with an opening 306*a* is provided in the light-transparent envelope 307, which separates the coils 304 and 305 and the magnetic material 303 from a light-emitting region.

Figure 4:
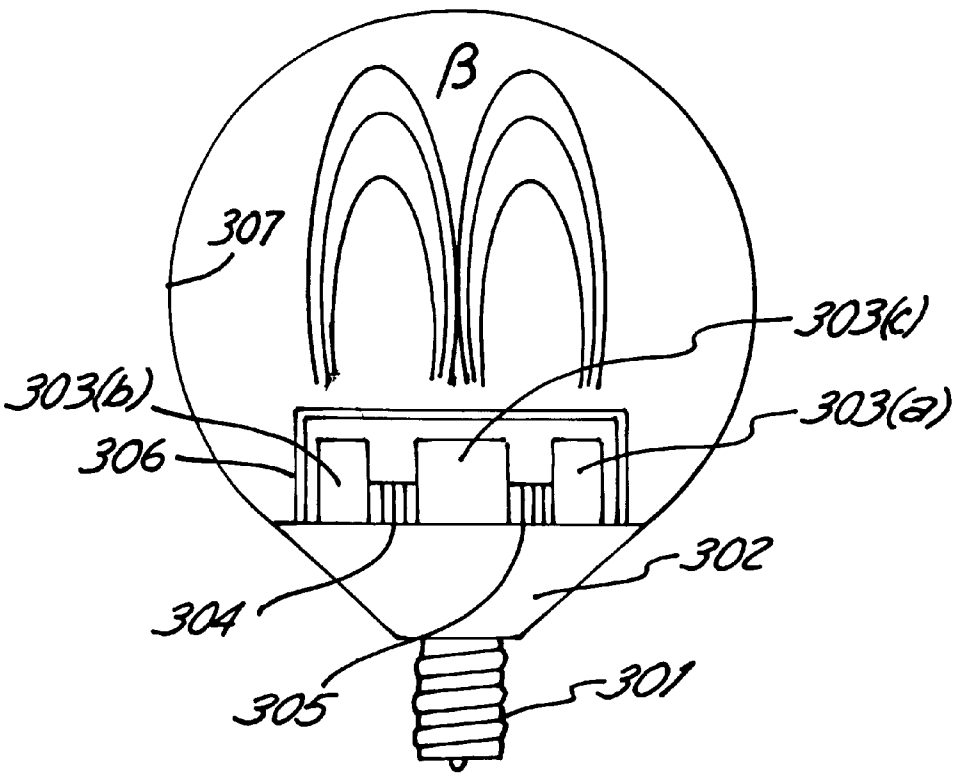
FIG. 4: A view showing the position of an AC magnetic field during operation in the electrodeless discharge lamp shown in FIG. 3.

The power source circuit receives utility power through the base 7 and applies a sinusoidal voltage to the coils 304 and 305. As a result, a sinusoidal current flows through the coils 304 and 305, a sinusoidal magnetic field is generated in the light-transparent envelope 307 and transmitted through the magnetic material 303 to be generated in the light-transparent envelope. The generated sinusoidal magnetic field is coupled with light-emitting gases in the light-transparent envelope 307 to emit UV or visible light. A part of the generated visible light is transmitted through the light-transparent envelope 307, and the generated UV light excites a phosphor coated on the inner surface of the light-transparent envelope to emit visible light. Due to the above-mentioned function, when the base 301 is supplied with utility power, the electrodeless discharge lamp in the present example emits visible light through the light-transparent envelope.

β in FIG. 4 represents a magnetic line of force generated by the coils 304 and 305 of tie electrodeless discharge lamp in the present example. A winding direction of tie coil 304 is opposite to that of the coil 305. Therefore, when one of the coils generates a magnetic field in the direction of the projection 303(*c*) of the magnetic material, the other coil also generates a magnetic field in the direction of the projection 303(*c*). When the coil 304 generates a magnetic field in the direction of the projection 303(*b*), the coil 305 generates a magnetic field in the direction of the projection 303 (*a*). Thus, depending upon the polarity of the AC generated by the power source circuit, the polarity of the generated magnetic field is varied. Because of this a magnetic line of force generated by the coils 304 and 305, as represented by β, comes out of the projection 303(*c*) and moves inside the light-transparent envelope 307 to be absorbed by the projections 303(*a*) and 303(*b*). Alternatively, a magnetic line of force generated by the coils 304 and 305 come out of the projections 303(*a*) and 303(*b*) and moves inside the light-transparent envelope 307 to be absorbed by the projections 303(*c*). In this case, three projections 303(*a*), 303(*b*) and 303(*c*) of the magnetic material are disposed substantially parallel to the axis of the light-transparent envelope 307. Therefore, the magnetic path in the magnetic material is curved and most of the magnetic field circulates in the light-transparent envelope 307 as represented by β and the magnetic field leaks less. Therefore, when compared with a conventional electrodeless discharge lamp, a plasma is more strongly generated in the light-transparent envelope 307 and coupled with more light-emitting gases to emit UV or visible light. Thus, the structure of the electrodeless discharge lamp in the present example has the advantage that the light emission efficiency is more satisfactory than the conventional electrodeless discharge lamp. Furthermore, compared with Example 1, the magnetic flux leaks less outside the light-transparent envelope 307 so that the improvement effect is greater. Furthermore, the magnetic field is dispersed more in the light-transparent envelope, so that there is the advantage that inconsistencies of brightness are less in terms of the outer appearance when the lamp in the present example is lighted.

Figure 5A:
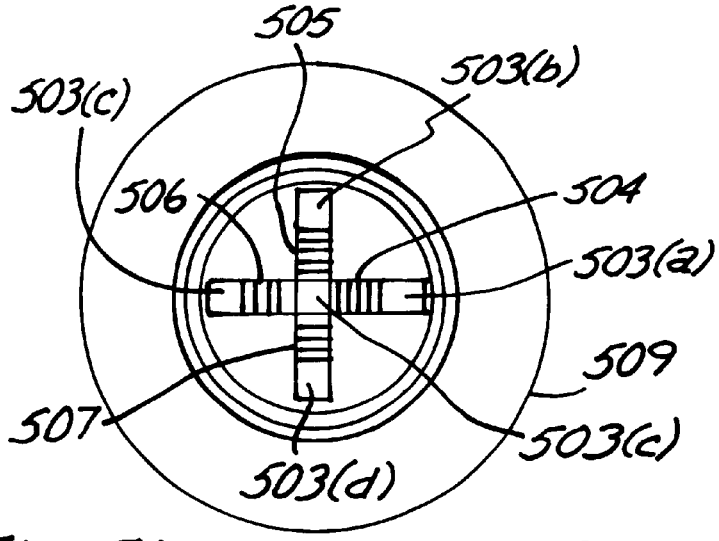
FIG. 5: Three cross-sectional views (a, b & c) of the main portion of a second embodiment of an electrodeless discharge lamp described in Example 2.
Figure 5B:
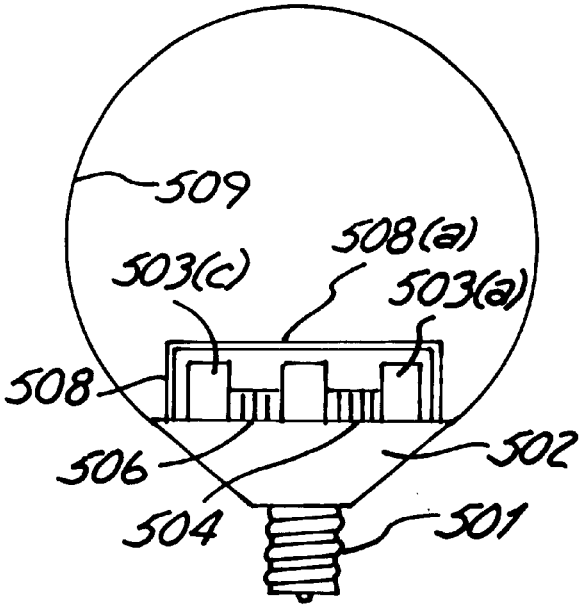
Figure 5C:
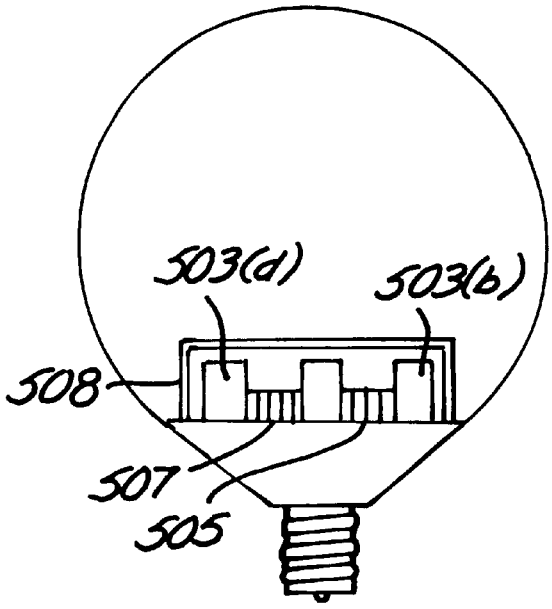

FIG. 5 shows three cross-sectional views of a main portion of an electrodeless discharge lamp according to another example of the present invention. Reference numeral 501 denotes a base for supplying AC power. Reference numeral 502 denotes a power source portion including a power source circuit generating an AC with a substantially sine wave waveform, which is connected to the base 501 and coils 504, 505, 506 and 507. The coils 504,505, 506 and 507 are respectively connected to the power source circuit in parallel and winding directions thereof are determined so all the magnetic fields arc directed in the direction 503(*e*) or in the direction opposite thereto when the coils are conducting.

Reference numeral 503 denotes a magnetic material, e.g. Mn—Zn ferrite. Furthermore, the magnetic material 503 is branched in a cross shape and has projections 503(*a*), 503(*b*), 503(*c*), 503(*d*) and 503(*e*) which are arranged in a position substantially parallel to the axis of the light-transparent envelope at five positions (four on tip ends of the cross and one in the vicinity of the center). The light-transparent envelope 509 has a substantially spherical shape and the inner surface thereof is coated with a phosphor which receives UV light and emits visible light. An inert gas (e.g., argon gas) and mercury are sealed in the light-transparent envelope 509 as light-emitting gases. A cover 508 with an opening 508*a* is provided in the light-transparent envelope 509 which separates the coils 504, 505, 506 and 507 and the magnetic material 503 from a light-emitting region.

The function and effect are the same as those in the example shown in FIG. 3. However, since the magnetic material is branched, the magnetic field is more dispersed in the light-transparent envelope 509. Furthermore, because of the presence of four winding portions 504, 505, 506 and 507, the number of windings can be increased in terms of a structure, which results in a high inductance. More specifically, in the example shown in FIG. 5, uniformity of brightness when the lamp is lighted is more satisfactory compared with the example shown in FIG. 3 and the light emission efficiency can be enhanced due to the high inductance.

Figure 6A:
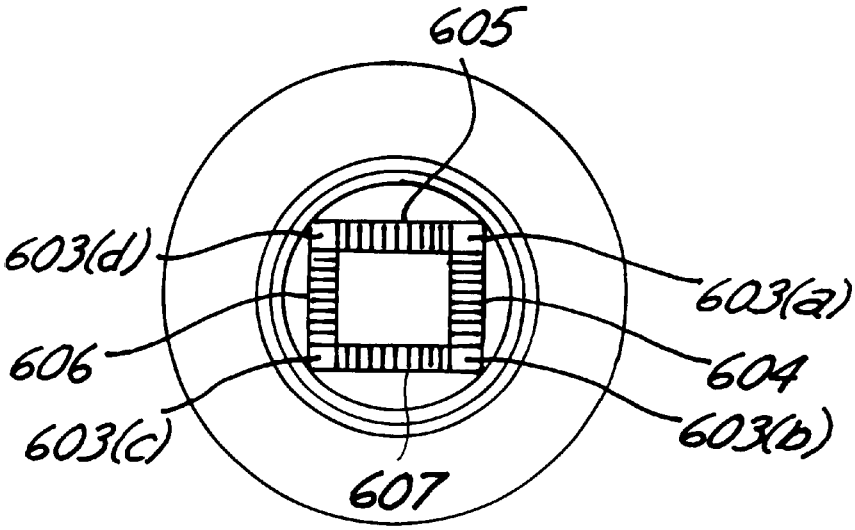
FIG. 6: Three cross-sectional views (a, b & c) of the main portion of a third embodiment electrodeless discharge lamp in Example 2.
Figure 6B:
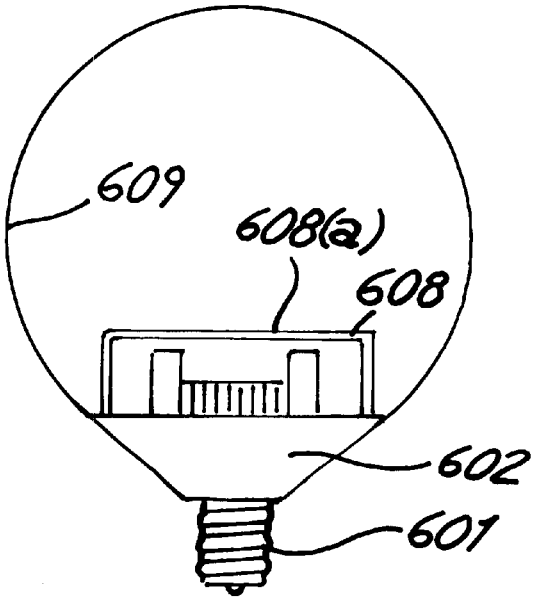
Figure 6C:
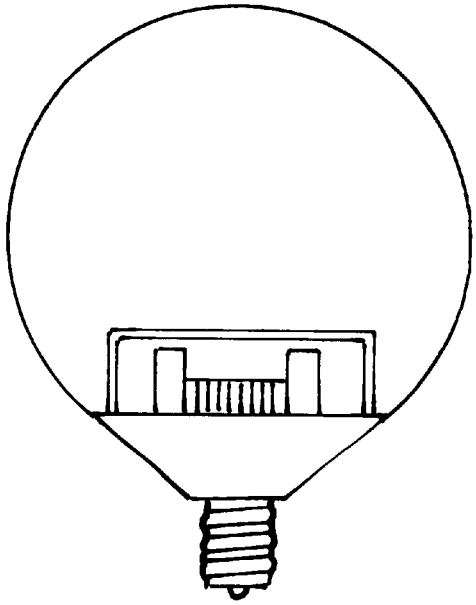

FIG. 6 shows three cross-sectional views of a main portion another embodiment of an electrodeless discharge lamp in the third example. Reference numeral 601 denotes a base for supplying AC power. Reference numeral 602 denotes a power source portion including a power source circuit generating an AC with a substantially sine wave waveform which is connected to the base 601 and coils 604, 605, 606 and 607. The coils 604, 605, 606 and 607 are connected in parallel. Winding directions of these coils are determined in such a manner that a magnetic field is directed in the direction 603(*a*) with respect to the coils 604 and 605 and a magnetic field is directed in the direction 603(*c*) with respect to the coils 606 and 607 or in such a manner that a magnetic filed is directed in an opposite direction thereto. Reference numeral 603 denotes a magnetic material, e.g., Mn—Zn ferrite. Furthermore, the magnetic material 603 is substantially square or substantially rectangular, and has projections 603(*a*), 603(*b*), 603(*c*) and 603(*d*) at four corners, directed substantially parallel to the axis of the light-transparent envelope. The light-transparent envelope 609 has a substantially spherical shape and the inner surface thereof is coated with a phosphor which receives UV light and emits visible light. An inert gas (i.e., argon gas) and mercury are sealed in the light-transparent envelope 609 as light-emitting gases. A cover 608 with an opening 608*a* is provided in the light-transparent envelope 609 and separates the coils 604, 605, 606 and 607 and die magnetic material 603 from a light-emitting region. The function and effect are the same as those in the example shown in FIG. 5.

As the shape of the magnetic material, a linear shape is shown in FIG. 3, a branched shape as shown in FIG. 5, a substantially rectangular shape or an annular shape such as a substantially rectangular shape as shown in FIG. 6 have been illustrated. However, the shape is not limited thereto. For example, a combined structure such as a combination of a branched shape and an annular shape and a combination of a linear shape and an annular shape may be used. Furthermore, the annular shape is not limited to a substantially square shape or a substantially rectangular shape. A substantially polygonal shape or a substantially oval shape may be used, In the present example, all the end portions of the magnetic material are directed substantially parallel to the axis of the light-transparent envelope. However, even if a part of the end portions are directed substantially parallel to the axis of the axis, substantially the same effect can be obtained.

In the present example, the vicinity of the end portions of the magnetic material is not coiled. However, by providing a coils in the vicinity of the end portions, an inductance of the coils is increased, and a light emission efficiency can be enhanced.

EXAMPLE 3

Figure 7A:
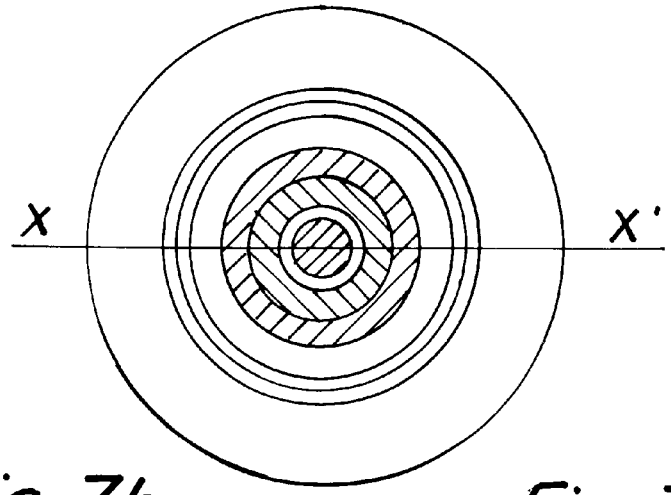
FIG. 7: Three cross-sectional views (a, b & c) of the main portion of another embodiment of an electrodeless discharge lamp as described in Example 3.
Figure 7B:
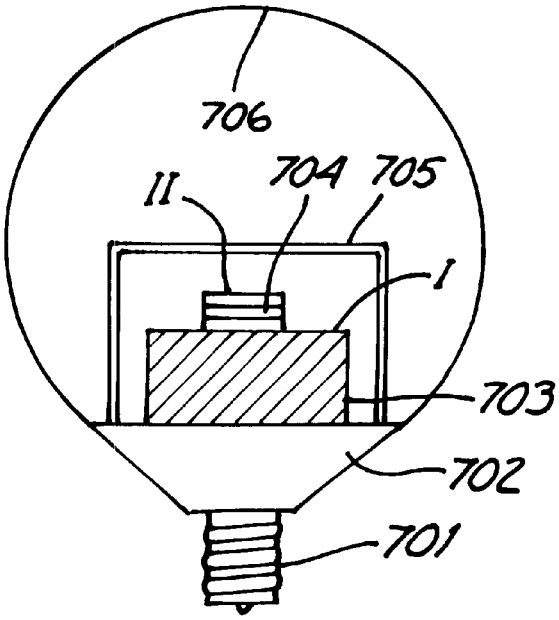
Figure 7C:
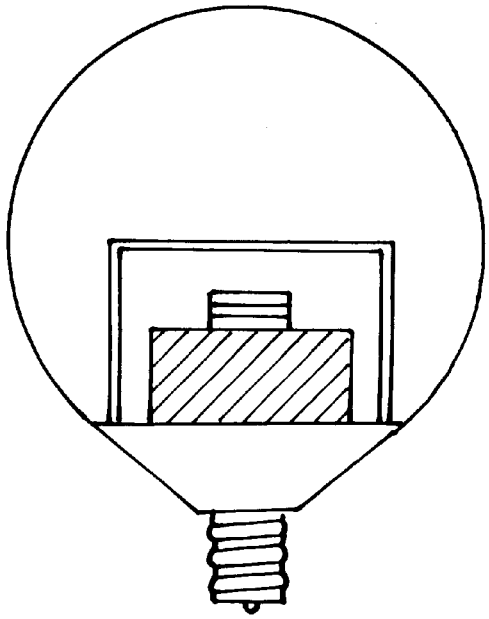
Figure 8:
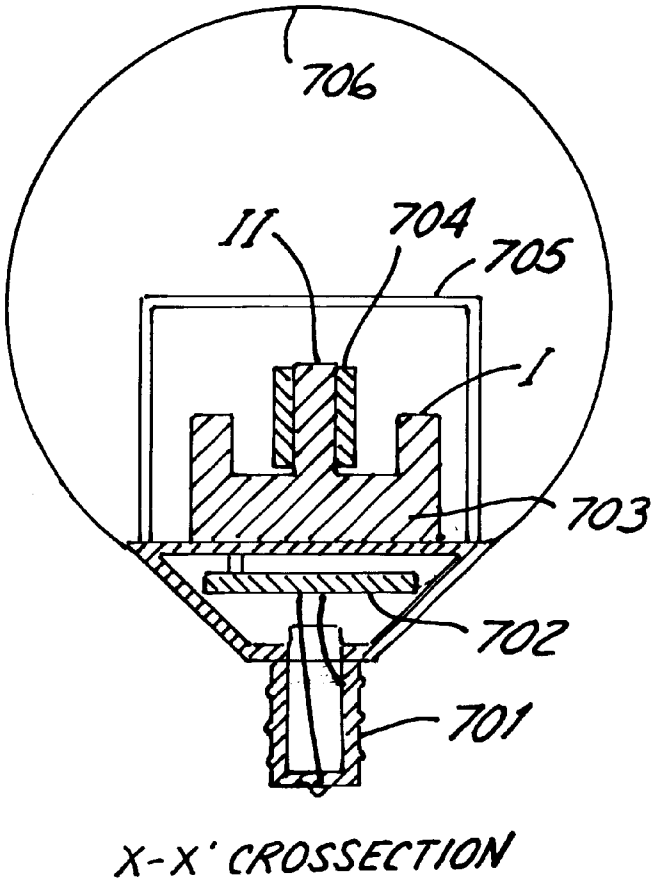
FIG. 8: A cross-sectional view taken along a line X–X' in the electrodeless discharge lamp shown in FIG. 7.

FIG. 7 shows three cross-sectional views of a main portion (light-transparent envelope) of an electrodeless discharge lamp in another example according to the present invention. FIG. 8 is a cross-sectional view taken along a line X–X' in FIG. 7(*a*). Reference numeral 701 denotes a base for supplying AC power. Reference numeral 702 denotes a power source portion including a power source circuit generating a substantially sine wave waveform, which is connected to the base 701 and a coil 704. Reference numeral 703 denotes a magnetic material, specifically, Mn—Zn ferrite. The magnetic material 703 is in the shape of a plate having a bar. The bar is disposed substantially parallel to the axis of the light-transparent envelope 706 or passes through the vicinity of the axis. A magnetic pole I, which is an edge portion substantially in the shape of a circle of the plate-shaped portion of the magnetic material 703 and a magnetic pole II, which is a tip end of the bar, form opposite polarities when a current flows through the coil 704. The transparent envelope 706 is a part of a sphere. Furthermore, the inner surface of the light-transparent envelope 706 is coated with a phosphor which receives UV light and emits visible light. Argon gas and mercury are sealed in the light-transparent envelope 706 as light-emitting gases. A cavity 705 is provided in the light-transparent envelope 706 which separates the coil 704 and the magnetic material 703 from a light-emitting region.

The power source circuit receives utility power through the base 701 to supply a sinusoidal voltage to the coil 704. A sinusoidal current flows through the coil 704 and is transmitted through the magnetic material 703 to be generated inside the light-transparent envelope. The generated sinusoidal magnetic field generates a plasma in the light-transparent envelope 706 to emit UV and/or visible light.

A part of the generated visible light is transmitted through the light-transparent envelope 706 and the generated UV light excites a phosphor coated on the inner surface of the light-transparent envelope to emit visible light. Due to the above-mentioned function, when the base 701 is supplied with utility power, the electrodeless discharge lamp in the present example emits visible light through the light-transparent envelope.

Figure 9:
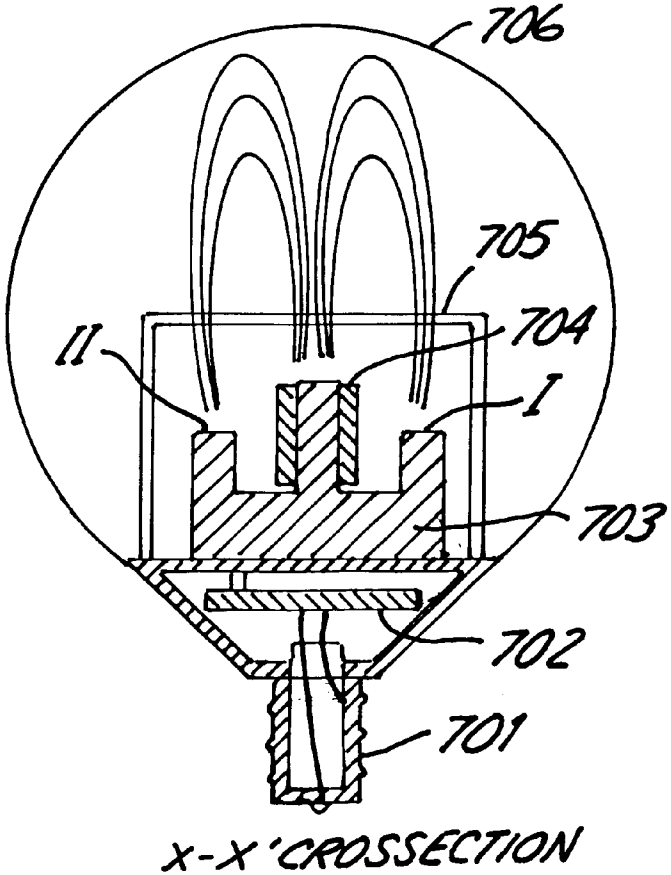
FIG. 9: A view showing the position of an AC magnetic field during operation in the electrodeless discharge lamp shown in FIGS. 7 and 8.

Y in FIG. 9 represents a sinusoidal magnetic field generated from the coil 704 of the electrodeless discharge lamp in the present example. A magnetic field in generated from the magnetic pole II due to an AC generated by the power source circuit and is absorbed by the magnetic pole I which is the plate-shaped edge portion, or follows the direction opposite thereto. As a result, when compared with a conventional electrodeless discharge lamp, more plasma is generated in the light-transparent envelope 706, and coupled with more light-emitting gases to emit more UV and/or visible light. Furthermore, because of the structure of the magnetic pole I, the magnetic field generated from the magnetic pole II spreads uniformly in the shape of a circle. Therefore, the magnetic field becomes uniform in the light-transparent envelope 706, whereby an electrodeless discharge lamp with uniform brightness can be provided.

Figure 10A:
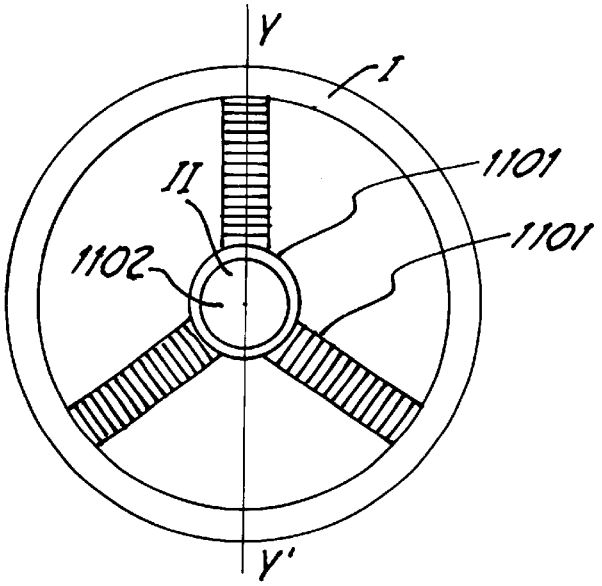
FIG. 10: Three cross-sectional views (a, b & c) of a coil portion in another electrodeless discharge lamp in Example 3.
Figure 10B:
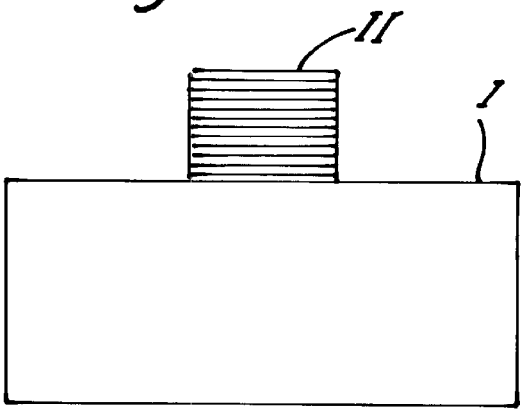
Figure 10C:
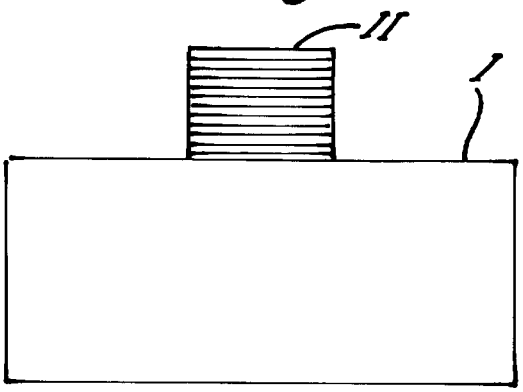
Figure 11:
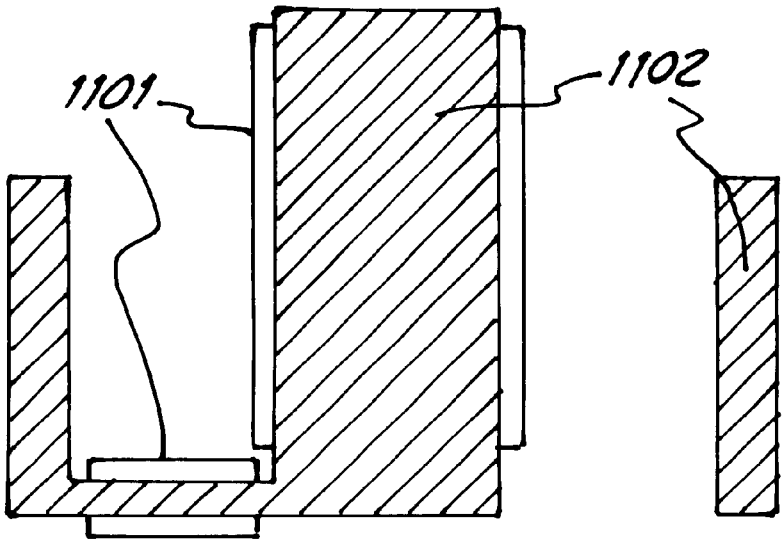
FIG. 11: A cross-sectional view taken along a line Y–Y' in the coil portion of the electrodeless discharge lamp shown in FIG. 10.
Figure 12:
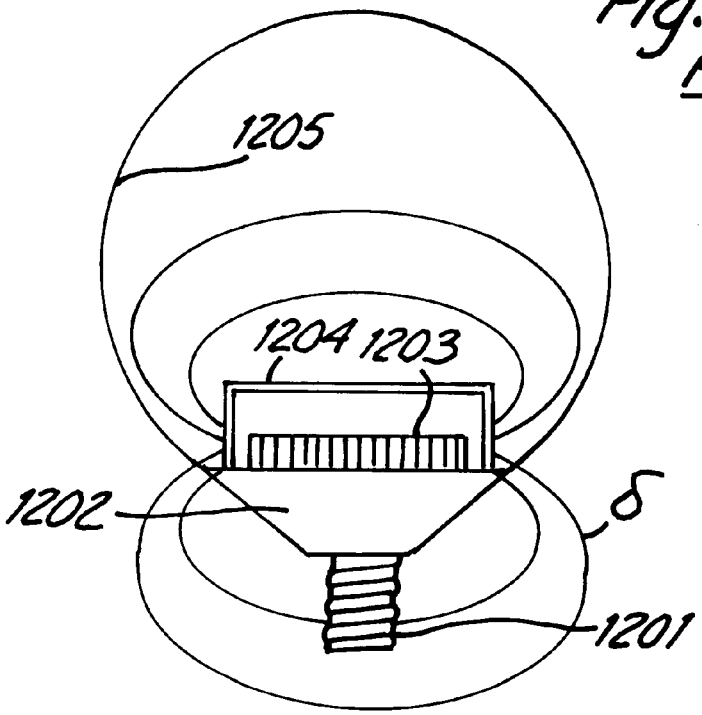
Fig. 12 PRIOR ART
FIG. 12: A cross-sectional view of the main portion of a prior art electrodeless lamp showing the position of an AC magnetic field during operation.

FIG. 10 shows three cross-sectional views of only the magnetic material of an electrodeless discharge lamp in another embodiment of the invention. FIG. 11 is a cross-sectional view taken along the line Y–Y' in FIG. 10(*a*). The other structures such as the base, power source portion, and light-transparent envelope, except for the magnetic material and coil, are the same as those in the example shown in FIG. 7. Reference numeral 1102 denotes a magnetic material, e.g., Mn—Zn ferrite. The magnetic material 1102 is in the shape of a plate having an axial bar. The bar is disposed substantially on the axis of the light-transparent envelope. Furthermore, the bottom of the plate shaped portion is composed of a magnetic material in the shape of one bar or a plurality of bars, a coil 1101 is wound around the bar-shaped bottom and a central bar. A magnetic pole I, which is an edge portion having a substantially circular shape of the plate-shaped portion of the magnetic material 1102, and a magnetic pole II, which is a tip end of the central bar, form opposite polarities, when a current flows through the coil 1101.

The function and effect are the same as those in the example shown in FIG. 7. However, since the bottom is in the shape of a bar and coiled, an electrodeless discharge lamp with an increased inductance and a more satisfactory light emission efficiency can be produced.

In the third example, the magnetic material has a structure in which the central bar is higher than the edge portion. However, the central bar may be as high as the edge portion or the central bar may be lower than the edge portion. Furthermore, although the edge portion is substantially in the shape of a circle, it may be a polygon.

In the above-mentioned three examples, an inert gas (e.g., argon) and mercury are sealed in the envelope. However, only an inert gas may also be sealed therein but combinations of an inert gas, mercury, metal halides may also be used.

In these examples, a bulbous shape is provided, in which a light-transparent envelope, a coil including a magnetic material, a power source circuit and a base are integrally formed. However, a structure in which the power source circuit is separated from the light-transparent envelope may be used. Any structure can be used as long as high-frequency power can be supplied to the coil.

In the above-mentioned example, the envelope having a substantially spherical shape is illustrated. However, an undefined pear or eggplant-like-shape may be used also and a ferrite substantially in the shape of an oval may be used.

In the above-mentioned examples, when a material magnetized in a specific direction is used for an entirety or a part of the magnetic material, directivity of generated magnetic flux can be further increased, and a lamp can be lighted with a satisfactory efficiency.

Furthermore, the base may have any structure as long as electric power can be supplied to the power source circuit.

Furthermore, the waveform applied to the coil is not limited to a sine wave. If another waveform such as a rectangular wave is used, a lamp having a further increased efficiency of light emission can be produced. Furthermore, the lamp may be driven at any frequency except for an extremely low frequency. If the frequency is in a range of 50 kHz to 500 kHz, the power source circuit can be constructed and a satisfactory efficiency of light emission can be obtained.

In the specification, it is described that an end portion of the magnetic material is disposed substantially on the axis of the light-transparent envelope. This means that the end portion is not exactly axial, but disposed in the direction closer to the light-transparent envelope compared with the direction pointed to by the end portion of a conventional linear magnetic material.

The material for the ferrite is not limited to that in the above-mentioned examples.

OPERATION OF THE LAMP BUILT ACCORDING TO EXAMPLE 3

The electrodeless compact fluorescent lamp designed and built in accordance with FIGS. 7*a* and 8 (Example 3) operated as follows:

The RF power of the frequency of 100 kHz is applied to the coil 704 from the driver and the matching network 702. The coil 704 is made from the multiple strands wire (Litz wire) each of gage #40. The number of turns varies from 40 to 80. In the preferred embodiment the number of strands was 60 and the coil 704 two layers of turns with the total number of turns of 65.

The coil 704 is wound around the central pole II of the magnetic core 703. The extension of the height of the edge core I increases the combined coil/core inductance thereby increasing the combined coil/core quality factor, $Q=\omega L_c/R_c$ is the equivalent coil/core resistance, $L_c$ is the coil/core inductance, and $\omega=2\pi f$ is the lamp driving angular frequency.

Figure 13:
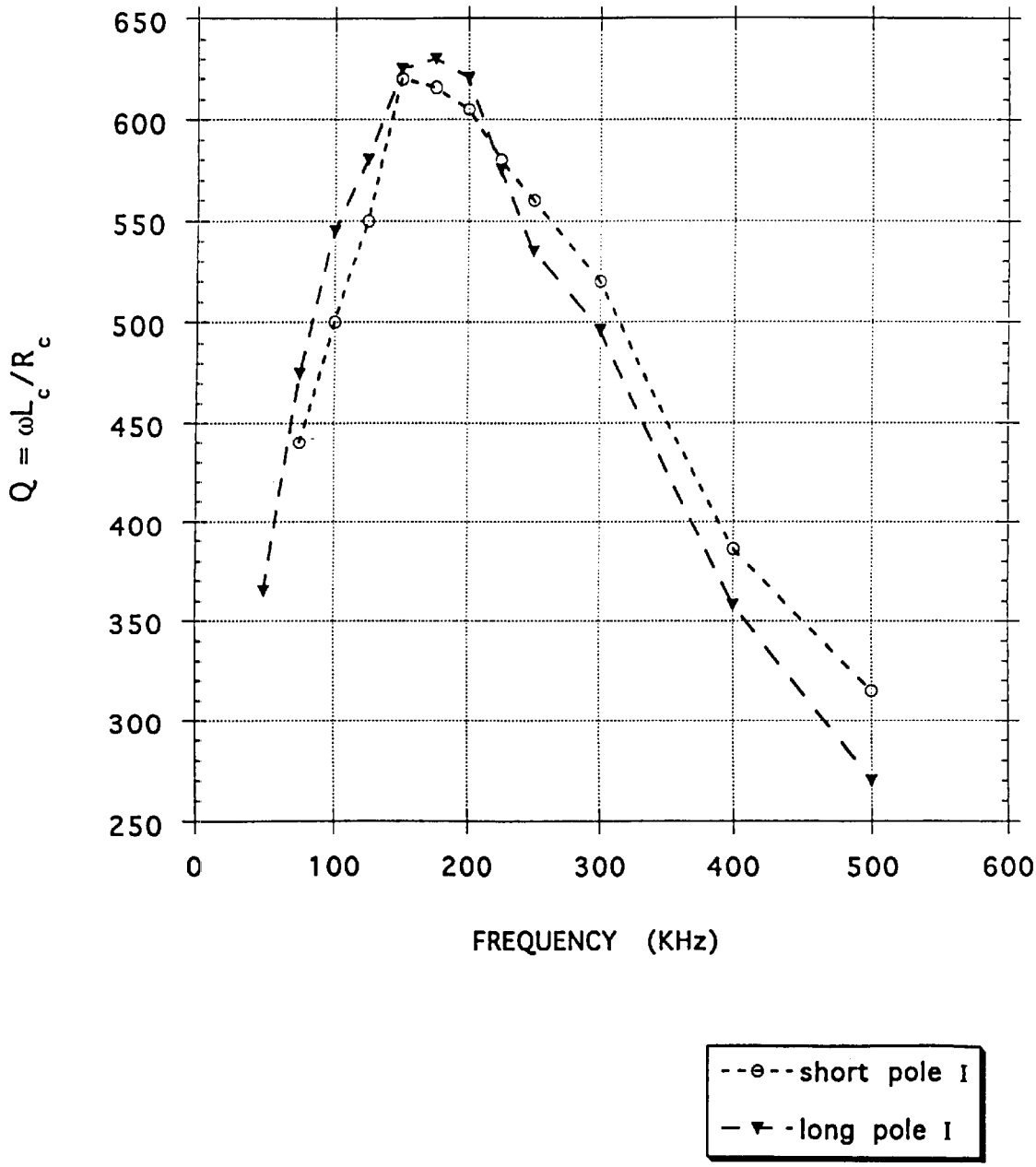
FIG. 13: A graph illustrating the dependencies of the coil/core quality factor, Q, for two different magnetic cores.

The dependencies of the coil/core quality factory, Q, for two magnetic cores 703 having different lengths of the pole I are given as a function of the driving frequency, f, in FIG. 13. It is seen that both dependencies have maximum at a frequency of 150–170 kHz. The core 703 with longer pole I has higher Q at lower frequencies, f<200 kHz due to the higher coil/core inductance, $L_c$. While at higher frequencies, f>200 kHz, the core 703 with shorter pole I provides slightly higher Q-factor, due to the lower equivalent coil/core resistance, $R_c$.

High Q-factor provided low coil/ferrite power losses, $P_{loss}$. In the preferred embodiment, the coil/core assembly having 65 turn coil and two poles—I (55 mm long) and II (5 mm long)—has low coil/ferrite power losses of about 3 W at a frequency of 100 kHz and RF power of 23 W delivered to the coil 704. The coil current, IM, needed to maintain the discharge in the lamp at 23 W was about 2.0 A (rms).

Low coil/ferrite power losses provide high lamp power efficiency, $\eta=P_{pl}/P_{lamp}=0.86$. The high lamp power efficiency results in high lamp efficacy.

The electrodeless compact fluorescent lamp was designed and built in accordance with the preferred embodiment shown in FIG. 8. It has the diameter of the envelope 706 of 60 mm, the diameter of the cavity 705 of 20 mm, and the core pole II height of 55 mm. The optimum mercury vapor pressure of 5–6 mtorr was maintained by the mercury drop at the envelope cold spot.

The lamp has light output of 1650 lumen at 25 W of the total lamp power, including those consumed by the driver, with lamp total efficacy at 66 LPW. The stabilized light output after continuous burning for 90 min was 1520 lumen that constitutes 92% of the maximum lamp light output.

Figure 14:
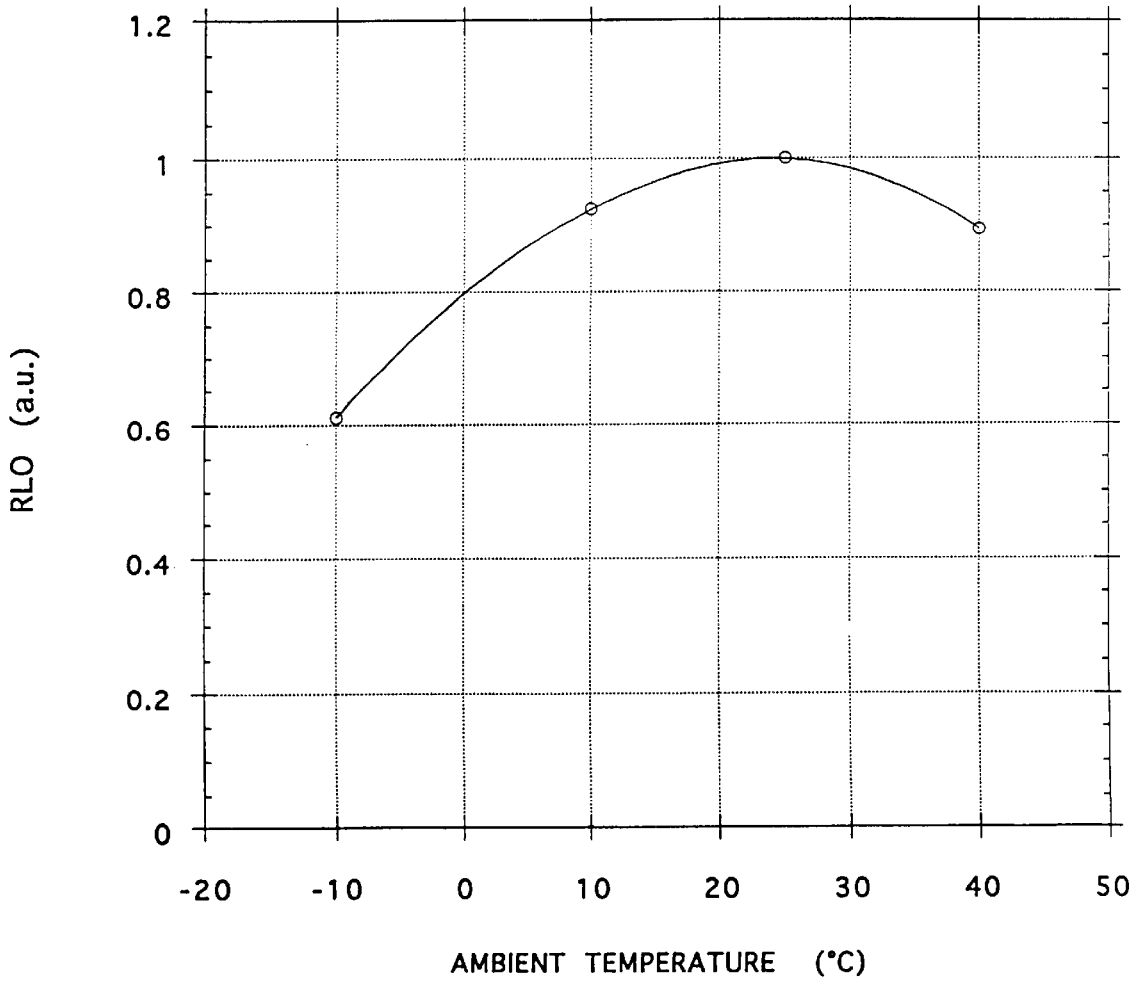
FIG. 14: A graph illustrating relative light output (RLO) at different ambient temperatures.

The relative light output (RLO) of the lamp measured at different ambient temperatures, $T^{amb}$, from −10° C. to +40° C., is plotted in FIG. 14. It is seen that with the maximum light output at +25° C., RLO, varies from 60% at $T_{amb}$=−10° C. to 90% at $T^{amb}$=+40° C.

EFFECT OF THE INVENTION

According to the present invention, a magnetic field which circulates in the light-transparent envelope is increased, and a magnetic field which leaks is decreased. Therefore, an electrodeless discharge lamp with a satisfactory light emission efficiency can be provided. Therefore, in such a envelope in brightness and heat generation caused by the movement of an operation point and leakage of a magnetic field are minimized.

Furthermore, nonuniformities in brightness caused by a bias of a magnetic field are suppressed when the lamp is lighted and uniform brightness can be obtained.

It is apparent that changes and modifications can be made within the scope of the present invention, but it is our intention only to be limited by the following claims.

As our invention we claim:

1. An electrodeless discharge lamp comprising:

a light-transparent envelope in which at least an inert gas is included; and at least one coil wound around a magnetic material for applying an electromagnetic field to the light-transparent envelope, wherein at least one end portion of the magnetic material in at least one coil is disposed substantially axially in the light-transparent envelope, wherein the end portion of the magnetic material is a portion where a magnetic line of force comes out or is absorbed.

2. An electrodeless discharge lamp according to claim 1 wherein the end portion of the magnetic material has a maximum magnetic flux density.

3. An electrodeless discharge lamp according to claim 1 wherein both ends of the magnetic material are disposed substantially axially in the light-transparent envelope.

4. An electrodeless discharge lamp comprising a light-transparent envelope in which at least one inert gas is sealed; and at least one coil wound around a magnetic material for applying an electromagnetic field to the light-transparent envelope, wherein the magnetic material has at least three end portions in at least one coil and all or a part of the end portions are directed substantially in an axial direction of the light-transparent envelope, wherein the end portion of the magnetic material is a portion where a magnetic line of force comes out or is absorbed.

5. An electrodeless discharge lamp according to any of claims 1–4 wherein the coil reaches a vicinity of the end portion of the magnetic material.

6. An electrodeless discharge lamp according to any of claims 1 and 4 wherein a part or an entirety of the magnetic material is a material magnetized in a specific direction.

7. An electrodeless discharge lamp according to any of claims 1 and 4 wherein a power source circuit which supplies high-frequency power to the coil is included in the lamp.

8. An electrodeless discharge lamp comprising:

a light-transparent envelope with a portion thereof containing a relatively large volume in which at least an inert gas is included; and at least one coil wound around and between the ends of a magnetic material core which are together positioned in the light-transparent envelope for providing an electromagnetic field in the light-transparent envelope such that at least one end portion of the magnetic material core in at least one coil is disposed substantially extending toward the center of lie relatively large volume contained in the corresponding portion of the light-transparent envelope.

9. An electrodeless discharge lamp according to claim 1 wherein both ends of the magnetic material core are disposed in the light-transparent envelope extending substantially toward the center of the relatively large volume contained in the corresponding portion of the light-transparent envelope.

10. An electrodeless discharge lamp according to claim 1 wherein plural coils and plural magnetic material cores are disposed in the light-transparent envelope with at least one end of each of those magnetic material cores extending substantially toward the center of the relatively large volume contained in the corresponding portion of the light-transparent envelope.

11. An electrodeless discharge lamp according to claim 2 wherein both ends of the magnetic material are disposed substantially axially in the light-transparent envelope.

* * * * *